US008684658B2

(12) United States Patent
Hannen et al.

(10) Patent No.: US 8,684,658 B2
(45) **Date of Patent: *Apr. 1, 2014**

(54) APPARATUS AND METHOD FOR ALIGNING STACK OF FLEXIBLE SHEETS ON TRANSPORT SUBSTRATE

(75) Inventors: Reiner Hannen, Kalkar-Wissel (DE); Norbert Vermeulen, Kleve-Warbeyen (DE)

(73) Assignee: MSK-Verpackungs-Systeme Gesellschaft mit beschrankter Haftung, Kleve (DE)

( * ) Notice: Subject to any disclaimer, the term of this patent is extended or adjusted under 35 U.S.C. 154(b) by 516 days.

This patent is subject to a terminal disclaimer.

(21) Appl. No.: 12/701,871

(22) Filed: Feb. 8, 2010

(65) Prior Publication Data

US 2010/0135763 A1 Jun. 3, 2010

Related U.S. Application Data

(62) Division of application No. 10/552,431, filed as application No. PCT/EP2005/001630 on Feb. 17, 2005, now Pat. No. 7,670,100.

(30) Foreign Application Priority Data

Feb. 17, 2004 (DE) ..... 20 2004 002 488 U
Feb. 17, 2004 (DE) ..... 20 2004 003 136 U

(51) Int. Cl.
*B65H 31/34* (2006.01)

(52) U.S. Cl.
USPC ..... 414/789.1

(58) Field of Classification Search
USPC ..... 414/788.9, 789.1, 789.9, 790.2, 795.7, 414/907; 271/224, 223, 210, 222, 221; 403/40, 179, 204, 266, 269, 270, 271; 267/112; 464/149; 100/3; 294/67.31, 294/67.33
See application file for complete search history.

(56) References Cited

U.S. PATENT DOCUMENTS 3,370,848 A * 2/1968 Bartlett ..... 271/221
3,822,795 A * 7/1974 Salsburg et al. ..... 414/788
3,961,714 A * 6/1976 Buehler ..... 414/572
RE31,060 E * 10/1982 Lutz ..... 414/788

(Continued)

OTHER PUBLICATIONS

Physics Classroom website; See http://www.physicsclassroom.com/class/vectors/u3l3b.cfm, discussion of vector forces as applied to horizontal and vertical components of a force applied to an article at an angle.*

*Primary Examiner* — Gregory Adams
(74) *Attorney, Agent, or Firm* — Berenato & White, LLC

(57) ABSTRACT

The invention relates to an apparatus for aligning an item that can be deformed easily, at least in the region of the outer lower edge. The apparatus has at least one aligning device that can be displaced in the direction of the item, and the transport substrate upon which the item is resting, in order to align the item on the transport substrate. For damage-free alignment of the item projecting laterally from the transport substrate contour, the subregion of the aligning device which comes into contact with the lower region of the item projecting laterally includes a stabilizing device. The stabilizing device prevents the item from being deflected, during the alignment process, in the direction of the transport substrate or, respectively, in a downward direction from the lower region of the item projecting laterally beyond the outer contour of the transport substrate.

14 Claims, 4 Drawing Sheets

(56) References Cited

U.S. PATENT DOCUMENTS 5,567,102 A * 10/1996 Tanaka ..... 414/274
6,045,324 A * 4/2000 Redman ..... 414/795.3
6,116,128 A * 9/2000 Long ..... 83/39
7,670,100 B2 * 3/2010 Hannen et al. ..... 414/789.1
2006/0280590 A1 * 12/2006 Hannen et al. ..... 414/802
2010/0135763 A1 * 6/2010 Hannen et al. ..... 414/788.9

* cited by examiner

APPARATUS AND METHOD FOR ALIGNING STACK OF FLEXIBLE SHEETS ON TRANSPORT SUBSTRATE

This application is a divisional of Ser. No. 10/552,431, filed Oct. 5, 2005 now U.S. Pat. No. 7,670,100, the entirety of which is incorporated herein by reference thereto. The aforementioned application is the National Phase of PCT/EP2005/001630, filed Feb. 17, 2005, published Sep. 1, 2005 as WO 2005/080243, and asserting priority from German Utility Models 202004003136.1, filed Feb. 17, 2004, and 202004002488.8, filed Feb. 17, 2004, each disclosure of which is incorporated herein by reference.

FIELD OF THE INVENTION

The invention relates to an apparatus for aligning an item that can be deformed easily, at least in the region of the outer lower edge, such as a stack of items comprising in particular flat structures made of a flexible material, such as paper or the like, on a transport substrate, such as a pallet, at least one aligning device that can be displaced in the direction of the item and the transport substrate being provided to align the item on the transport substrate.

Apparatuses of this type are used in practice in order, for example, to align the item in relation to the transport substrate before the packaging operation and after the loading operation.

Alignment is necessary in order that the item is arranged within the contour of the transport substrate since regions of the item projecting beyond the contour can be damaged during subsequent transport, for example by adjacent pallets.

Known aligning devices comprise two continuous displaceable walls, which are assigned to each other horizontally or vertically and which in each case are moved in parallel or together in the direction of the item and in this way the item is aligned in relation to the transport substrate.

The alignment of flat structures in particular, such as stacks of paper, proves to be problematical. For example, when paper is being cut to size, crosscutters are used, as a result of the which the paper stack may not be positioned centrally on the transport substrate but instead may project by up to 40 mm on the longitudinal side and/or the transverse side of the transport substrate. Since paper can be damaged very easily in the region of the projection during transport, alignment is required in particular under all circumstances in the case of stacks of paper.

Previously known mechanical devices cannot be used since, during the alignment with these devices, the lower edges are bent downward as a result of the fore of the alignment device and can be clamped in between the transport substrate and the aligning device. Apart from the fact that the bent-down sheets can no longer be used, the bent-down sheets also prevent further displacement, so that satisfactory alignment is not possible. Given a lack of technical solutions, the stacks of paper are therefore aligned by hand. Here, in the region of the projection, the transport substrate is moved into the desired position by means of specific blows.

SUMMARY OF THE INVENTION

It is therefore an object of the invention to improve a known apparatus in such a way that an item projecting laterally beyond the outer contour of a transport substrate can be moved mechanically into the contour of the transport substrate and damage to the item during alignment can be avoided.

This object is achieved in that at least the subregion of at least one aligning device which comes into contact with the lower region of the item projecting laterally beyond the outer contour of the transport substrate during the alignment of the item on the transport substrate is assigned a stabilizing device which prevents the item being deflected in the direction of the transport substrate.

During the displacement of the item, if the latter is formed as a stack of paper, the stabilizing device in particular prevents the lower sheets bending over downward and being turned over, and in this way the item can be pushed at least sufficiently far that it terminates flush with the contour of the transport substrate. The aligning device can be formed, for example, as a displaceable wall. However, it is also entirely possible for appropriate displaceable walls to be provided on two opposite sides, between which the item is aligned.

The stabilizing device can include a layer which inhibits slipping. In this way, the friction between the aligning device and the item is increased, so that slippage of the item, in particular when this is a stack of paper, in the region of the edge in contact with the aligning device is prevented.

It is recommended that the stabilizing device includes a compliant element. This has the effect that, during displacement, the compliant element bears from below on the lower edge of the item and in the process exerts a supporting force on the item such that bending over or turning over of the lower region of the item is prevented.

The element can be made of rubber, for example, such as foam rubber or cellular rubber.

Other embodiments of a stabilizing device are possible. For example, the stabilizing device can comprise a supporting device for supporting the item. This can be, for example, an angle integrally molded on the aligning device, which can be used when transport substrates of a defined height are employed. This angle supports the item on the underside.

In another embodiment, the stabilizing device can have a supporting surface adjoining the contact surface of the transport substrate laterally at a short distance, at least during the alignment, and at least approximately aligned with the contact surface. This supporting surface can be moved into its operating position, for example by moving in the direction of the transport substrate or by pivoting. The height of the supporting surfaces can preferably be varied, so that transport substrates of different heights can also be employed. In the operating position of the supporting surface, the aligning device which, for example, is formed as a displaceable wall, is moved along the upper side of the supporting surface at a short distance, so that when the aligning device is displaced in the direction of the item, the item is displaced and the lower flat structures of the item are protected by the supporting surfaces against being bent over.

The aligning devices can be formed in one piece. However, it is also entirely possible for the aligning devices to be formed in many parts, at least in an upper and a lower segment, in relation to the height of the item, and the stabilizing device can be provided at least on the lower segment.

In this case, it is recommended that the adjacent edges have mutually at least approximately corresponding edge curves with projecting and set-back subregions, in particular are formed in the shape of a wave and interengaging. If the aligning device is formed in two parts, it is recommended for the stabilizing device, if it includes a compliant element, to be provided at least in the lower segment. In this case, it is recommended for the upper segment to be capable of being moved onward in the direction of the item at least by the thickness of the compliant element in the compressed state, in order to prevent an edge offset in the region of the item.

The height of at least one aligning device is matched to the upper edge of the transport substrate in such a way that movement beyond the edge of the transport substrate is possible. This makes it possible for the item to be displaceable beyond the edge on the transport substrate.

The invention also relates to a method for aligning an item that can be deformed easily, at least in the region of the outer lower edge, such as a stack of items comprising in particular flat structures made of a flexible material, such as paper or the like, on a transport substrate, such as a pallet, at least one aligning device that can be displaced in the direction of the item and the transport substrate being provided to align the item on the transport substrate.

Alignment methods are carried out in practice in order, for example, to align the item in relation to the transport substrate before the packaging operation and after the loading operation.

Alignment is necessary in order that the item is arranged within the contour of the transport substrate since regions of the item projecting beyond the contour can be damaged during subsequent transport, for example by adjacent pallets.

In known alignment methods, aligning devices are used which comprise two continuous displaceable walls, which are assigned to each other horizontally or vertically and which in each case are moved in parallel or together in the direction of the item and in this way the item is aligned in relation to the transport substrate.

The alignment of flat structures in particular, such as stacks of paper, proves to be problematical. For example, when paper is being cut to size, crosscutters are used, as a result of the which the paper stack may not be positioned centrally on the transport substrate but instead may project by up to 40 mm on the longitudinal side and/or the transverse side of the transport substrate. Since paper can be damaged very easily in the region of the projection during transport, alignment is required in particular under all circumstances in the case of stacks of paper.

Previously known mechanical devices cannot be used since, during the alignment with these devices, the lower edges are bent downward as a result of the force of the alignment device and can be clamped in between the transport substrate and the aligning device. Apart from the fact that the bent-down sheets can no longer be used, the bent-down sheets also prevent further displacement, so that satisfactory alignment is not possible. Given a lack of technical solutions, the stacks of paper are therefore aligned by hand. Here, in the region of the projection, the transport substrate is moved into the desired position by means of specific blows.

It is therefore an object of the invention to specify a method with which an item projecting laterally beyond the outer contour of a transport substrate can be moved mechanically into the contour of the transport substrate and damage to the item during alignment can be avoided.

This object is achieved in that a downward deflection of the lower region of the item projecting laterally beyond the outer contour of the transport substrate is prevented by a stabilizing device which is assigned to at least the subregion of the aligning device which comes into contact with the region of the item projecting laterally beyond the outer contour of the transport substrate during the alignment of the item on the transport substrate. During the displacement of the item, if the latter is formed as a stack of paper, the use of the stabilizing device in particular prevents the lower sheets bending over downward and being turned over. In this way the item can be pushed at least sufficiently far that it terminates flush with the contour of the transport substrate. The aligning device(s) can be formed, for example, as a displaceable wall. However, it is also entirely possible for appropriate displaceable walls to be provided on two opposite sides, between which the item is aligned.

In this case, before the alignment of the item on the transport substrate, the transport substrate can for its part be aligned in relation to at least one aligning device. For this purpose, use can be made for example of stoppers, which are preferably arranged transversely with respect to the conveying direction and are moved against the transport substrate. As a result, the transport substrate is aligned parallel with the conveying direction.

In order to reduce friction between the underside of the item and the contact surface of the transport substrate, a friction-reducing layer can be provided. In this way, the item can be displaced more easily on the transport substrate.

A thin sheet can be laid on the transport substrate as a layer before the loading of the transport substrate with the item. In another embodiment, a film, in particular an oil film, can be applied to the underside of the item as a layer.

BRIEF DESCRIPTION OF THE DRAWINGS

In the following text, an exemplary embodiment of the invention illustrated in the drawings will be explained. In the drawings.

DETAILED DESCRIPTION

In all the figures, the same designations are used for the same or identical components.

Figure 1:
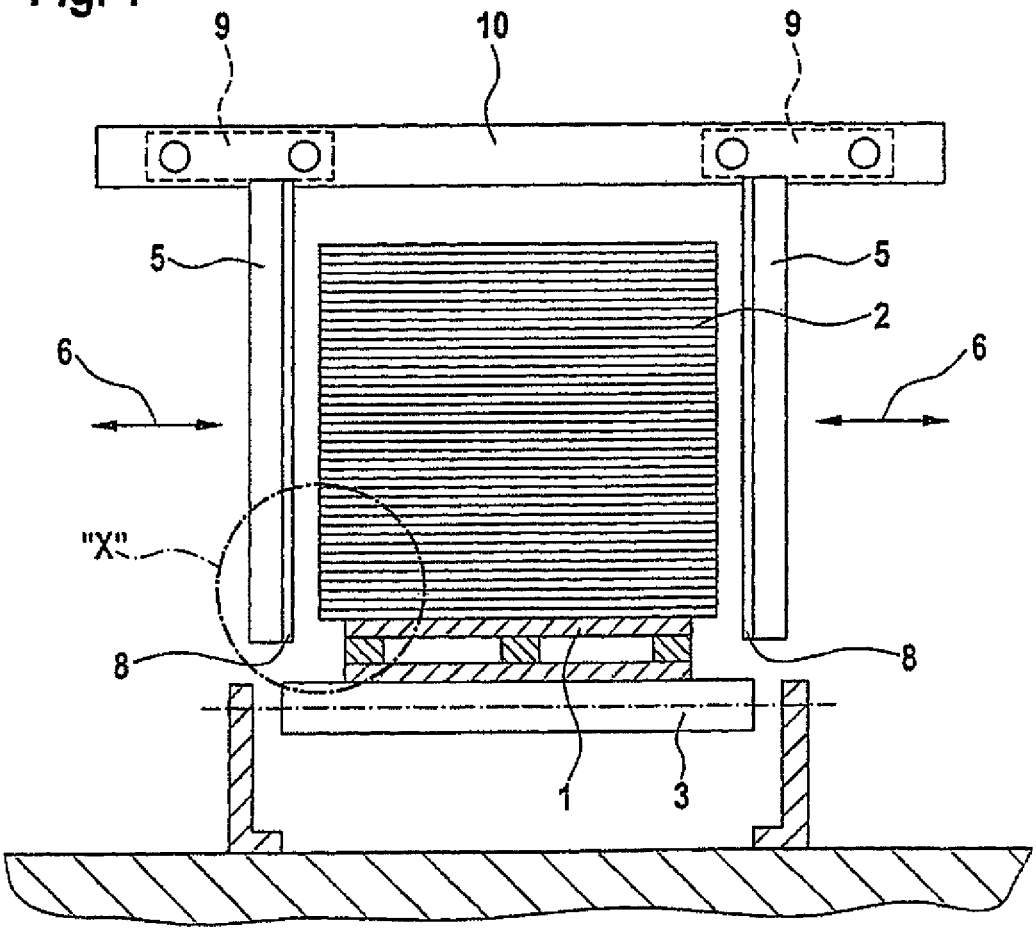
FIG. 1 shows a side view of an apparatus according to the invention.
Figure 2:
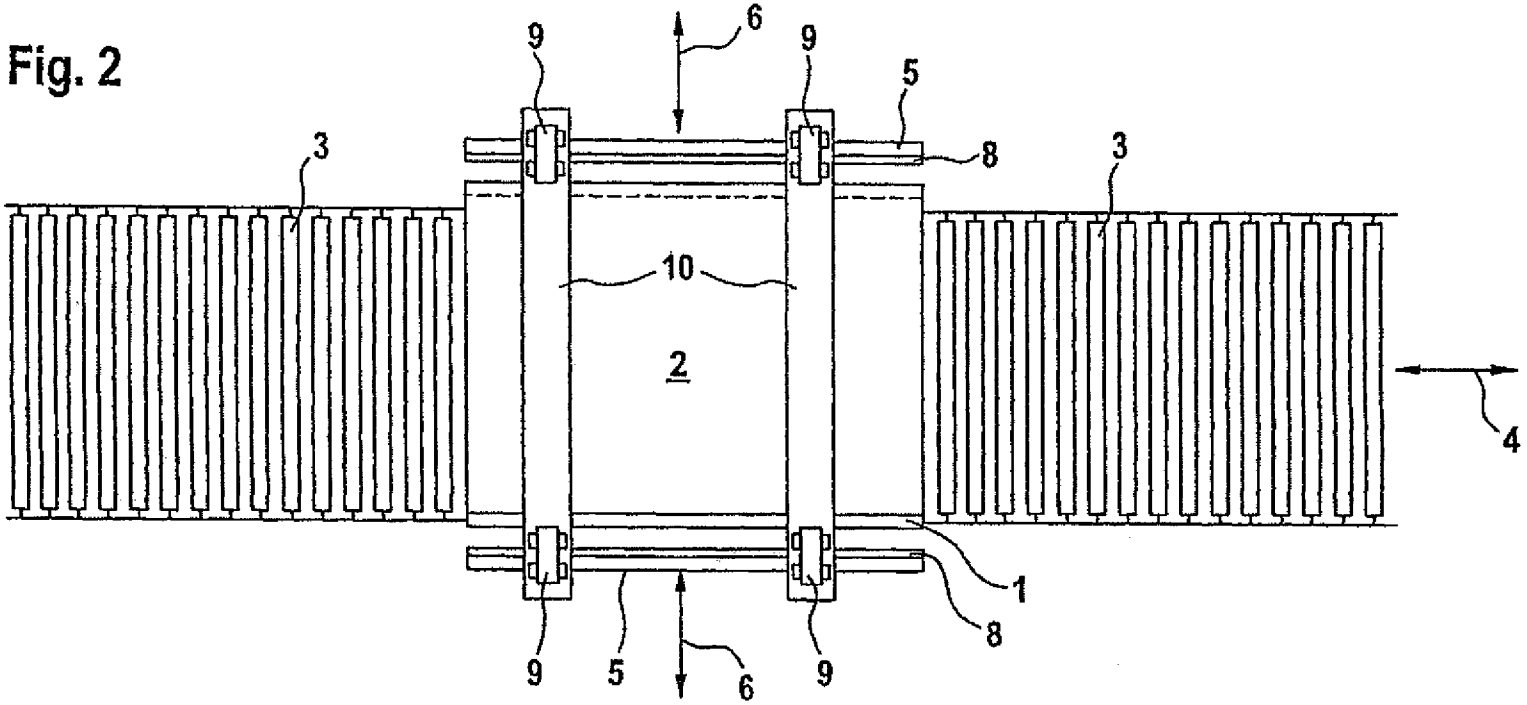
FIG. 2 shows a plan view of the subject according to FIG. 1.

In FIGS. 1 and 2, a transport substrate 1 formed as a pallet is illustrated, on which an item 2 is stacked. The item 2 has previously been placed on the transport substrate 1 by a loading device, not illustrated and connected upstream of the aligning operation. The item 2 is flat structures, such as paper, which are stacked on one another and, in the exemplary embodiment illustrated, project beyond the transport substrate 1 on the left-hand side.

On the underside, the transport substrate 1 stands on a roller conveyor 3. By means of this roller conveyor 3, the transport substrate 1 with the item 2 located on it is, for example, moved from a loading device to the apparatus according to the invention, the transport substrate 1 previously being aligned with respect to the roller conveyor 3 in order that the transport substrate 1 is aligned parallel to the conveying device 4. For this purpose, for example, stoppers arranged transversely with respect to the conveying device 4 and against which the transport substrate 1 is moved can be provided in the roller conveyor 3.

In order to align the item 2, the apparatus, as illustrated in FIGS. 1 and 2, has an aligning device 5 on both sides of the roller conveyor 3, each aligning device 5 being formed as a displaceable flat wall which is aligned parallel with the conveying direction 4. The aligning devices 5 can be moved toward the item 2 in the direction of the arrows 6. They can be driven individually or together.

Figure 3:
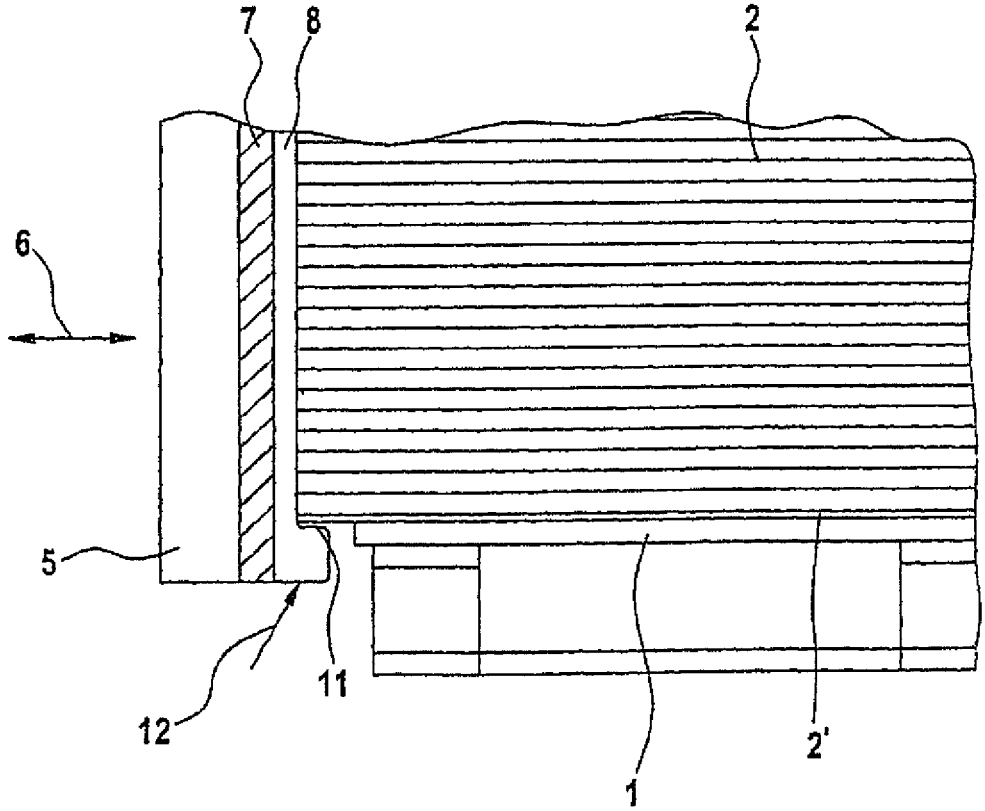
FIG. 3 shows the detail "X" from FIG. 1.

In the exemplary embodiment illustrated in FIG. 3, a wooden board 7 is provided on the side of the aligning device 5 facing the item 2. On the side of the wooden board 7 itself facing the item 2 there is in turn fitted a stabilizing device 8 which, in the exemplary embodiment illustrated, includes a compliant element.

The aligning devices 5 are held in a supporting construction 10 by roller arrangements 9. During alignment, first of all the left-hand aligning device 5 illustrated in FIG. 1 meets the item 2. In the process, the compliant material is compressed, the compliant material bearing on the lower edge 11 of the item 2 and developing a supporting force in the direction of the arrow 12 and in this way preventing the lower paper layers bending over or turning over. During further displacement in the direction of the arrow 6, each stabilizing device 8 comes into contact with the transport substrate 1 with the region on the underside projecting beyond the item 2. Because of the compliance of the stabilizing device 8, however, the displacement movement can be continued until the outer edge of the item 2 terminates flush with the outer edge of the transport substrate 1.

For the case in which alignment and thus movement of the item 2 beyond the contour of the transport substrate 1 is desired, the aligning devices 5 have to be matched to the height of the transport substrate 1 in such a way that the aligning devices 5 in the lower region can be moved over the upper edge of the transport substrate 1.

The compliant material used can be, for example, a foam rubber or a closed-cell, resilient cellular rubber having cell sizes of 0.2 to 0.5 mm. In this case, the surface of the material coming into contact with the item 2 is preferably formed so as to be closed, so that air escaping during compression must necessarily emerge via the front edges, of which the area is smaller.

In the exemplary embodiment illustrated in FIGS. 1 and 2, the item 2 is aligned in the region of the longitudinal edges. If alignment in the region of the shorter side edges is desired, aligning devices 5 must likewise be provided in these regions. In the rest position, the aligning devices 5 are located completely out of the active range of the roller conveyor 3. For the alignment, the aligning devices 5 are moved orthogonally with respect to the conveying direction 4 until in the desired position.

Figure 4:
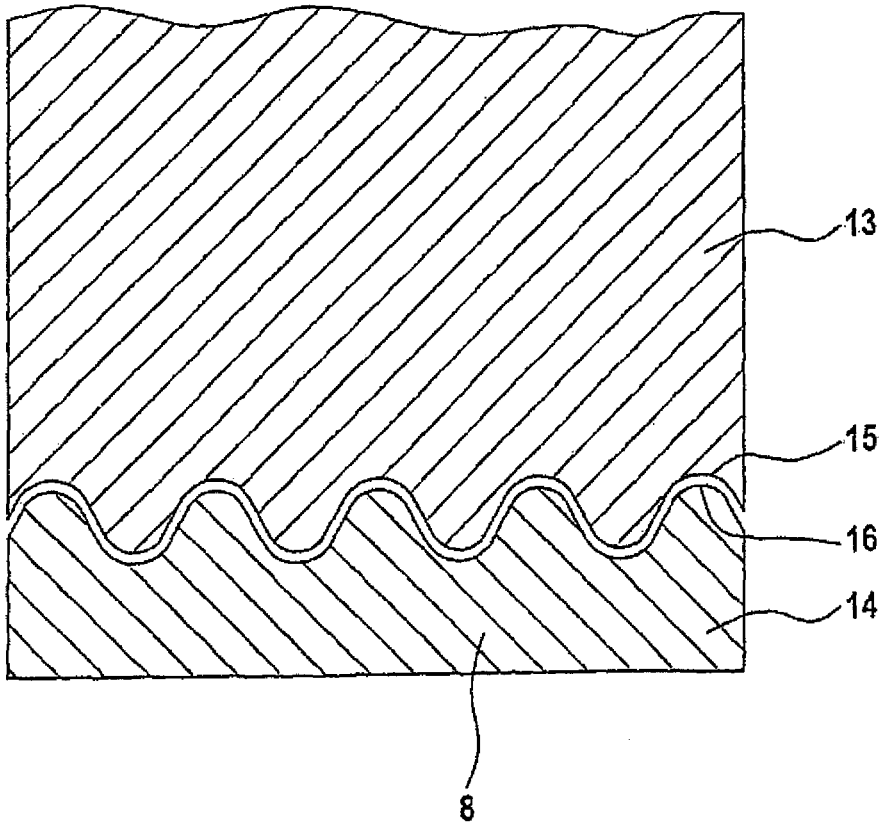
FIG. 4 shows a plan of a multi-part aligning device.

In FIGS. 1 to 3, the aligning devices 5 are formed in one piece. FIG. 4 shows a divided aligning device 5 which is divided into an upper and a lower segment 13, 14. In this case, the adjacent edges 15, 16 have mutually at least approximately corresponding edge curves with projecting and setback subregions. In the exemplary embodiment illustrated, the edges 15, 16 are formed in the shape of waves. The stabilizing device 8 including the compliant element is in this case provided on the lower segment 14.

The upper segment 13 is preferably moved further in the duration of the item 2 by the thickness of the stabilizing device 8 in the compressed state. In conjunction with the interengaging edge curves, an offset within the side edge of the item 2 can thus be avoided.

In order to reduce the friction between the item 2 and a contact (or support) surface of the transport substrate 1, a friction-reducing layer 2' having a low coefficient of friction can be provided. The layer 2' can be a thin layer of lubricant, such as oil, or a low-friction foil between the transport substrate 1 and the lowest paper underlayer (as shown in FIG. 3). For example, the lowest paper layer can be oiled, i.e., coated with lubricant, such as oil.

The provision of a thin sheet proves to be advantageous in as much as a thin sheet cover subsequently drawn over the item 2 following the alignment can be welded to the thin sheet and in this way the item 2 is protected against moisture.

The invention claimed is:

1. An apparatus for aligning an entire stack of flexible sheets resting on a transport substrate, with respect to said transport substrate, wherein a lowermost outer edge portion of said entire stack projecting laterally past at least one edge of said transport substrate, said apparatus comprising:

a substantially vertically disposed aligning element moveable linearly horizontally toward and away from said one edge of said transport substrate, said aligning element having a flat face directed toward said entire stack; and a resilient and compressible slip-preventing layer attached to said flat face of said aligning element and extending below said lowermost outer edge portion of said entire stack so that engagement occurs between said resilient slip-preventing layer of said aligning element and said entire stack of said flexible sheets beneath said laterally projecting lowermost outer edge portion of said entire stack of said flexible sheets;

said resilient slip-preventing layer is oriented relative to said entire stack so that, when said aligning element is shifted horizontally toward said entire stack and engages said projecting lowermost outer edge portion of said entire stack, said slip-preventing layer apples a force to said projecting lowermost outer edge portion;

said force having a vertical component providing a supporting and lifting force acting to said projecting lowermost outer edge portion of said entire stack and a horizontal component pushing said entire stack inward on said transport substrate, thereby altering the respective alignment of said entire stack on said transport substrate without downwardly bending or deflecting said flexible sheets that form said lowermost outer edge of said entire stack.

2. The apparatus defined in claim 1, wherein said slip-preventing layer is made of an elastomer.

3. The apparatus defined in claim 1, wherein said aligning element has an upper part and a lower part movable relative to each other in the direction toward and away from said edge of said transport substrate.

4. An apparatus for aligning an entire stack of flexible sheets resting on a transport substrate, with respect to said transport substrate, wherein an outer lower edge portion of said entire stack projecting laterally past at least one edge of said transport substrate, said apparatus comprising:

a substantially vertically disposed aligning element moveable linearly horizontally toward and away from said one edge of said transport substrate, said aligning element having a flat face directed toward said entire stack; and a resilient and compressible slip-preventing layer attached to said flat face of said aligning element so that engagement occurs between said resilient slip-preventing layer of said aligning element and said laterally projecting outer lower edge portion of said entire stack of said flexible sheets;

said resilient slip-preventing layer is oriented relative to said entire stack so that, when said aligning element is shifted horizontally toward said entire stack and engages said projecting outer lower edge portion of said entire stack, said slip-preventing layer apples a force to said projecting outer lower edge portion;

said force having a vertical component providing a supporting and lifting force acting to said projecting outer lower edge portion of said entire stack and a horizontal component pushing said entire stack inward on said transport substrate, thereby altering the respective alignment of said entire stack on said transport substrate without downwardly bending or deflecting said flexible sheets that form said outer lower edge of said entire stack;

said aligning element having an upper part and a lower part movable relative to each other in the direction toward and away from said edge of said transport substrate;

said upper and lower parts joined together at a non-planar interface.

5. A method of aligning an entire stack of flexible sheets lying on a transport substrate having an outer edge, wherein a lowermost outer edge portion of said stack is projecting laterally past one of said edge of said transport substrate, said method using an aligning element having a vertical flat face directed toward said entire stack, said flat face including a resilient slip-preventing layer extending below said lowermost outer edge portion of said entire stack, said method comprising the steps of:

pressing said resilient slip-preventing layer of said aligning element against said laterally projecting lowermost outer edge portion of said entire stack of flexible sheets so as to compress said resilient slip-preventing layer against said lowermost outer edge portion of said entire stack such that a portion of said resilient slip-preventing layer extends beneath said laterally projecting lowermost outer edge portion of said entire stack;

engaging and supporting said lowermost outer edge portion of said stack with said resilient slip-preventing layer beneath said laterally projecting lowermost outer edge portion thereby creating a force applied to said projecting outer lower edge portion, said force having an upward and inward components with respect to said stack and preventing deflection of said lowermost outer edge portion; and shifting said entire stack with respect to said transport substrate by movement of said vertical face of said slip-preventing layer of said aligning element without occurrence of downward bending of said flexible sheets.

6. The method defined in claim 5, further comprising the step of aligning said transport substrate relative to said aligning element, the aligning step preceding the pressing step.

7. The method defined in claim 5, further comprising the step of reducing friction between a lowermost sheet of said stack and said transport substrate.

8. The method defined in claim 6, wherein friction is reduced by providing a low-friction layer between said lowermost sheet and said transport substrate.

9. The method defined in claim 6, wherein friction is reduced by coating said lowermost sheet with a lubricant.

10. A method of aligning an entire stack of flexible sheets lying on a transport substrate having an outer edge, wherein a lowermost outer edge portion of said stack is projecting laterally past one of said edges of said transport substrate, said method using a substantially vertically disposed aligning element extending below said lowermost outer edge portion of said entire stack, and comprising the steps of:

pressing a substantially horizontal support element mounted on said aligning element against and beneath said laterally projecting lowermost outer edge portion of said entire stack of flexible sheets;

engaging and supporting said lowermost outer edge portion of said stack with said support element thereby creating a force having upward and inward components with respect to said stack and preventing deflection of said lowermost edge, said force applied to said projecting lowermost outer edge portion; and shifting said entire stack with respect to said transport substrate by movement of said aligning element without downward bending of said flexible sheets occurring.

11. The method defined in claim 10, further comprising a step preceding the pressing step, wherein aligning said transport substrate relative to said aligning element occurs.

12. The method defined in claim 10, further comprising the step of reducing friction between a lowermost sheet of said stack and a support surface of said transport substrate on which it rests.

13. The method defined in claim 12, wherein friction is reduced by providing a low-friction layer between said lowermost sheet and said transport substrate.

14. The method defined in claim 12, wherein friction is reduced by coating said lowermost sheet with a lubricant.

* * * * *